US010486205B1

(12) United States Patent
Carter

(10) Patent No.: US 10,486,205 B1
(45) Date of Patent: Nov. 26, 2019

(54) METHOD AND APPARATUS FOR CLEANING AN OIL AND GAS WELL RISER ASSEMBLY WITH MULTIPLE TOOLS SIMULTANEOUSLY

(71) Applicant: TRI-STATE ENVIRONMENTAL, LLC, Houma, LA (US)

(72) Inventor: Anthony Scott Carter, Petal, MS (US)

(73) Assignee: TRI-STATE ENVIRONMENTAL, LLC, Houma, LA (US)

( * ) Notice: Subject to any disclaimer, the term of this patent is extended or adjusted under 35 U.S.C. 154(b) by 0 days.

(21) Appl. No.: 16/216,222

(22) Filed: Dec. 11, 2018

Related U.S. Application Data

(63) Continuation of application No. 15/162,484, filed on May 23, 2016, now Pat. No. 10,195,650.
(Continued)

(51) Int. Cl.
*B08B 7/04* (2006.01)
*B08B 9/043* (2006.01)
(Continued)

(52) U.S. Cl.
CPC ..... *B08B 9/0433* (2013.01); *B08B 5/04* (2013.01); *E21B 17/01* (2013.01)

(58) Field of Classification Search
CPC ..... B08B 5/04; B08B 9/0433; B08B 9/0321; B08B 9/04; B08B 9/0495; E21B 17/01;
(Continued)

(56) References Cited

U.S. PATENT DOCUMENTS 1,704,364 A * 3/1929 Markley ..... B08B 9/0433 134/168 C
2,117,648 A * 5/1938 Bottorf ..... B24C 5/04 134/24

(Continued)

*Primary Examiner* — Alexander Markoff
(74) *Attorney, Agent, or Firm* — Garvey, Smith & Nehrbass, Patent Attorneys, L.L.C.; Charles C. Garvey, Jr.; Mackenzie D. Rodriguez

(57) ABSTRACT

The present invention is directed to a method of cleaning an oil and gas well riser section that has a central larger diameter tubular member having a flow bore and a plurality of smaller diameter tubular members connected to the central larger diameter tubular member, each smaller diameter tubular member having a flow bore. The method includes placing a fitting on an end portion of the riser section, the fitting covering an end of the larger diameter tubular member and the ends of the smaller diameter tubular members, wherein the fitting preferably has multiple openings including one or more centrally located openings and a plurality of circumferentially spaced apart outer openings that are spaced radially away from each of the one or more centrally located openings, said fitting having a drain opening. A cleaning tool is preferably inserted through the centrally located opening and into the larger diameter tubular member, wherein said pressure washing tool cleans the inside surface of the larger diameter tubular member. The cleaning tool is then preferably inserted through one of the outer openings and into one of the smaller diameter tubular members, wherein said second pressure washing tool cleans the inside surface of the smaller diameter tubular member. Fluid from the cleaning operations is preferably removed (suctioned) via the fitting discharge. The outer openings are preferably positioned along a curved line that is radially spaced outwardly of the centrally located openings. Preferably all tubular members are cleaned simultaneously or substantially simultaneously.

22 Claims, 21 Drawing Sheets

Related U.S. Application Data

(60) Provisional application No. 62/191,991, filed on Jul. 13, 2015, provisional application No. 62/164,978, filed on May 21, 2015.

(51) Int. Cl.
*B08B 5/04* (2006.01)
*E21B 17/01* (2006.01)

(58) Field of Classification Search
CPC ..... E21B 17/006; E21B 37/02; E21B 37/04; E21B 21/00; E21B 41/00
See application file for complete search history.

(56) References Cited

U.S. PATENT DOCUMENTS 5,159,956 A * 11/1992 Kurihara ..... F28G 9/00 134/169 C
5,217,166 A * 6/1993 Schulze ..... B05B 3/0463 239/227
5,323,797 A * 6/1994 Rankin ..... B05B 1/14 134/167 C
5,964,414 A * 10/1999 Hardy ..... B05B 3/005 239/252
6,158,076 A * 12/2000 Rutkowski ..... E03F 9/005 15/104.31
6,454,009 B2 * 9/2002 Carmichael ..... E21B 21/103 134/167 C
7,040,331 B2 * 5/2006 Garman ..... B08B 9/0433 134/167 C
8,118,091 B2 * 2/2012 Baker ..... B65D 59/02 138/89
9,844,803 B1 * 12/2017 Carter ..... B08B 9/04
10,125,577 B1 * 11/2018 Carter ..... E21B 41/00
10,174,564 B1 * 1/2019 Carter ..... E21B 17/006
10,195,650 B1 * 2/2019 Carter ..... B08B 9/0433
2001/0018976 A1 * 9/2001 Carmichael ..... E21B 21/103 166/312
2004/0050553 A1 * 3/2004 Edvardsen ..... E21B 37/00 166/367
2011/0052328 A1 * 3/2011 Frerich ..... E21B 17/01 405/224.2
2014/0060849 A1 * 3/2014 Pathak ..... E21B 33/037 166/344

* cited by examiner

METHOD AND APPARATUS FOR CLEANING AN OIL AND GAS WELL RISER ASSEMBLY WITH MULTIPLE TOOLS SIMULTANEOUSLY

CROSS-REFERENCE TO RELATED APPLICATIONS

This application claims the benefit of U.S. Provisional Patent Application No. 62/164,978, filed 21 May 2015; and U.S. Provisional Patent Application No. 62/191,991, filed 13 Jul. 2015, which are incorporated herein by reference. Priority of U.S. Provisional Patent Application No. 62/164,978, filed 21 May 2015; and U.S. Provisional Patent Application No. 62/191,991, filed 13 Jul. 2015 is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the cleaning of oil and gas well riser sections or assemblies. More particularly, the present invention relates to a method and apparatus for cleaning an oil and gas well riser section or assembly that includes a larger diameter central pipe and a plurality of smaller diameter pipes that are spaced radially away from the central larger diameter pipe. Even more particularly, the present invention relates to an improved method and apparatus for cleaning oil and gas well riser sections wherein a specially configured cap or pair of caps are fitted to the ends of the riser which enable pressure washing cleaning tools (or a camera) to be inserted into and through a selected one of the pipes including either a smaller diameter of the pipes or the central larger diameter pipe and wherein the cap continuously collects spent cleaning fluid and debris.

2. General Background of the Invention

Oil and gas well riser sections typically include a central larger diameter pipe or tubular member that is surrounded by a plurality of three or four or more smaller diameter pipes held in spaced relation to the central pipe with plates or flanges. Flanges are provided at each end of the riser assembly or riser section. These flanges include openings that communicate with the bore or bores of the smaller diameter pipes. The flange has a central opening that communicates with the bore of the central larger diameter pipe.

In order to clean these pipe sections, it is necessary to remove rust, scale, debris, chemical deposits and the like from both the inner larger diameter pipe section bore as well as the smaller outer or peripherally placed pipe section bores.

BRIEF SUMMARY OF THE INVENTION

The present invention thus provides a method and apparatus for cleaning oil and gas well riser sections wherein the riser section includes a central larger diameter pipe or tubular member having a flow bore and a plurality of smaller diameter pipes or tubular members that are preferably connected to the central larger diameter tubular member with flanges or spacers. Each of the smaller diameter tubular members has a flow bore.

The method includes placing a first cap or fitting on one end portion of the riser section. The fitting preferably covers an end of the larger diameter tubular member as well as the ends of the smaller diameter tubular members. The fitting preferably has multiple openings including one or more centrally located openings and a plurality of circumferentially spaced apart outer openings that are each spaced radially away from the one or more centrally located openings.

The fitting can include a cylindrically shaped portion and a circular portion that is preferably joined to cylindrically shaped portion. A flexible sealing member preferably helps join the cap or fitting to an end of the riser assembly.

The method includes inserting a first cleaning tool through the centrally located opening and into the larger diameter tubular member. The cleaning tool includes a pressure washing tool that cleans the inside surface of the larger diameter tubular member. A cable preferably supplies fluid under pressure to the first cleaning tool.

The method includes the inserting of a cleaning tool through one or more of the outer or peripherally placed openings and into one of the smaller diameter tubular members. The smaller diameter tubular members are cleaned with a second pressure washing tool that preferably cleans the inside surface of the smaller diameter tubular member or members, one after the other.

The method includes the suction of fluid from the cleaning operations via a fitting or discharge that is preferably placed at a lower end portion of the fitting so that gravity flow can remove such cleaning fluid on a continuous basis.

The outer openings are positioned along a curved line that is radially spaced outwardly of the centrally located opening or openings, the curved line traversing each of the outer tubular members.

In one embodiment, each centrally located opening is generally aligned with the bore of the larger diameter tubular member.

In one embodiment, one or more outer openings are generally aligned with the bore of a smaller diameter tubular member.

In one embodiment, the riser section or assembly has one end portion with an annular flange, each tubular member connected to the flange and the fitting preferably attaches to the annular flange.

In one embodiment, the flange has an outer diameter and the fitting has a peripheral skirt with a seal having a diameter that is about equal to the flange outer diameter. Further, the method includes attaching the fitting at the peripheral skirt to the annular flange.

In one embodiment, there are a pair of caps or fittings, a fitting preferably being attached to each end portion of the riser section or assembly.

In one embodiment, a suction is preferably applied to each of the caps or fittings to subject all flow bores of the riser section to a vacuum during cleaning operations.

In one embodiment, the vacuum at least partially contributes to securing the caps or fittings to the riser section.

In one embodiment, there are at least three outer openings.

In one embodiment, there are between two and twenty outer openings.

In one embodiment, the outer openings are preferably arranged in a circle.

In one embodiment, some of the outer openings are aligned with a smaller diameter tubular member bore and some of the outer openings are not aligned with a smaller diameter tubular member bore.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
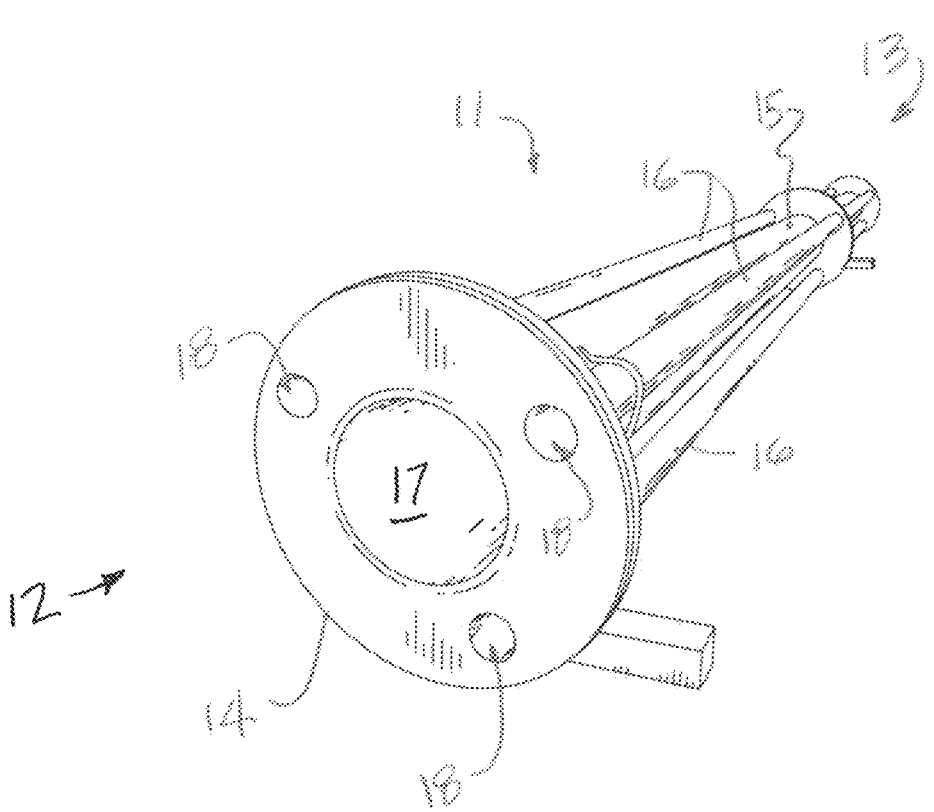
FIG. 1 is a perspective view of a riser pipe to be cleaned using the method and apparatus of the present invention.
Figure 2:
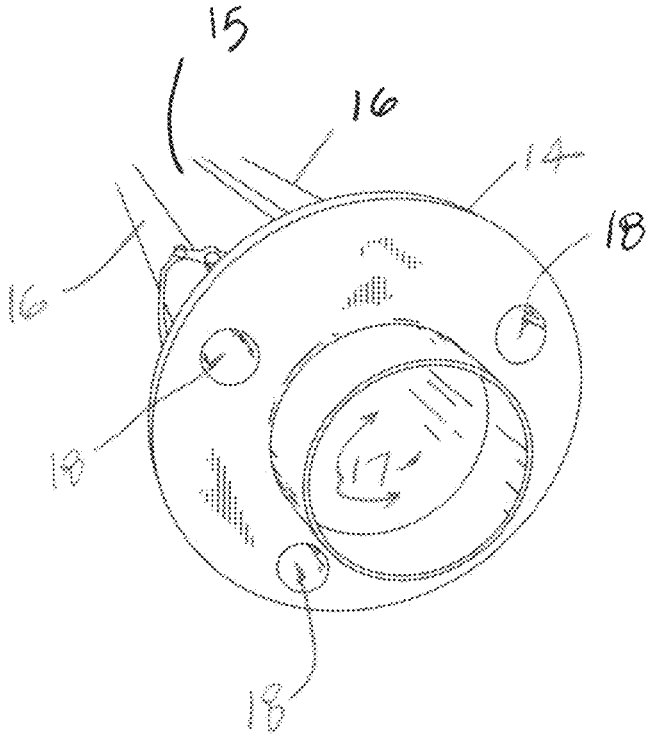
FIG. 2 is a perspective view of a riser pipe to be cleaned using the method and apparatus of the present invention.
Figure 3:
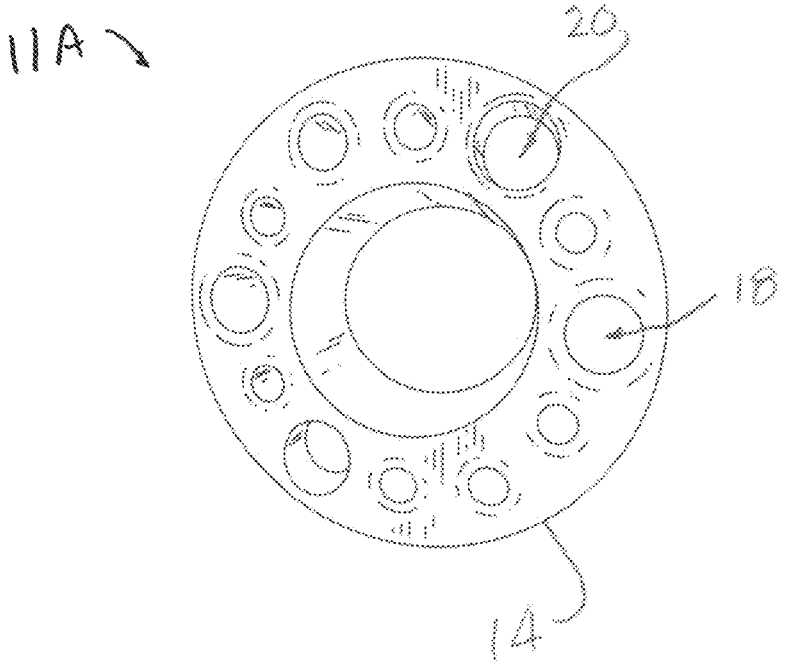
FIG. 3 is a perspective view of a riser pipe to be cleaned using the method and apparatus of the present invention.
Figure 4:
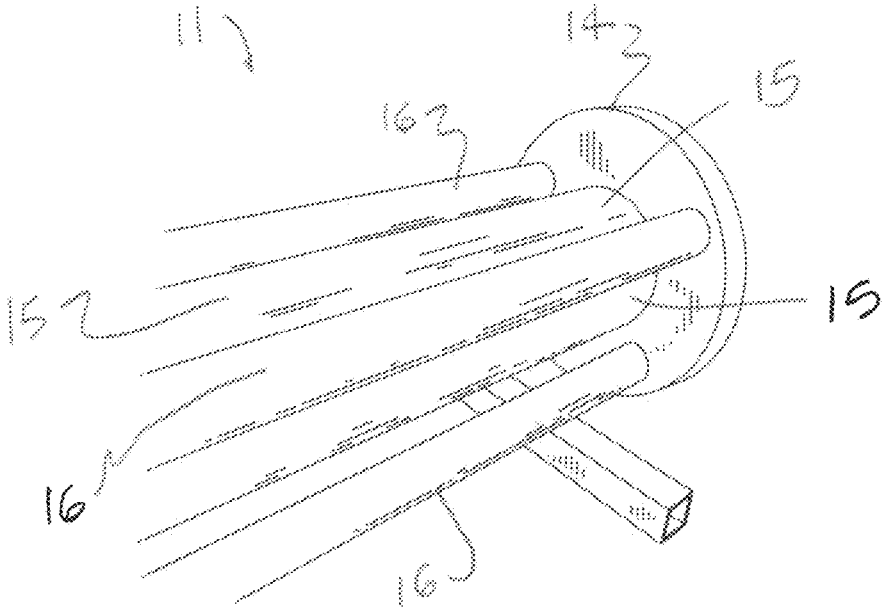
FIG. 4 is a perspective view of a riser pipe to be cleaned using the method and apparatus of the present invention.
Figure 5:
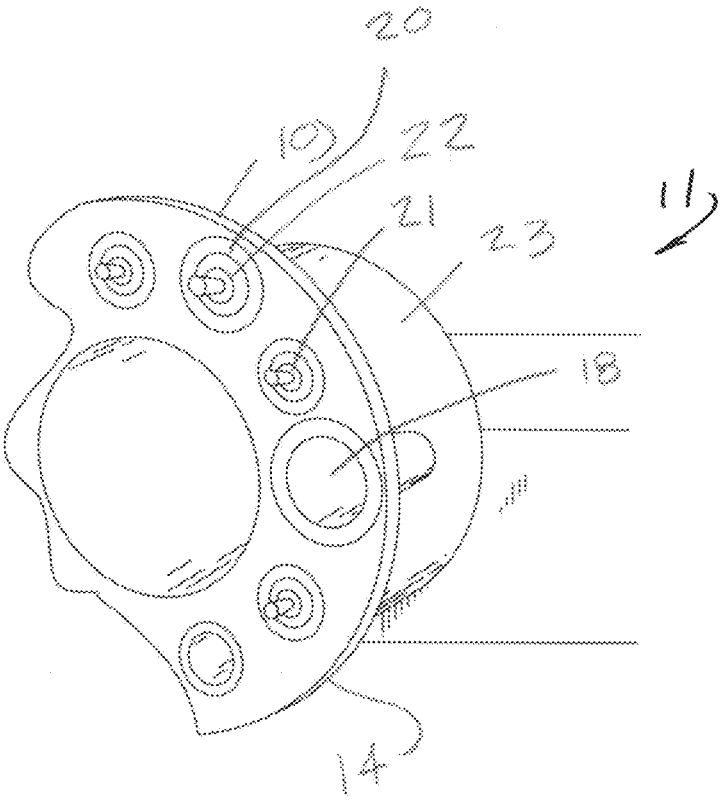
FIG. 5 is a perspective view of a riser pipe to be cleaned using the method and apparatus of the present invention.
Figure 6:
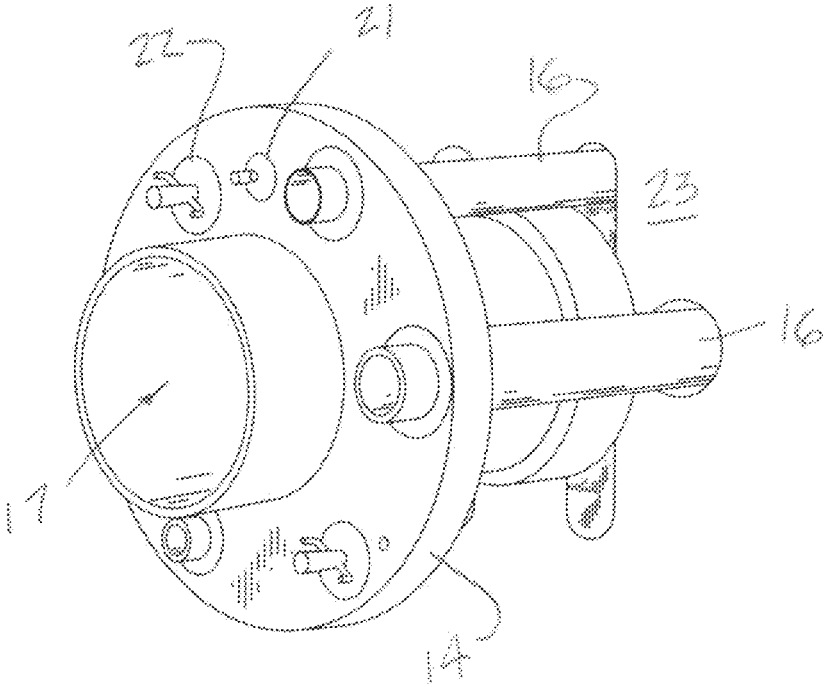
FIG. 6 is a perspective view of a riser pipe to be cleaned using the method and apparatus of the present invention.
Figure 13:
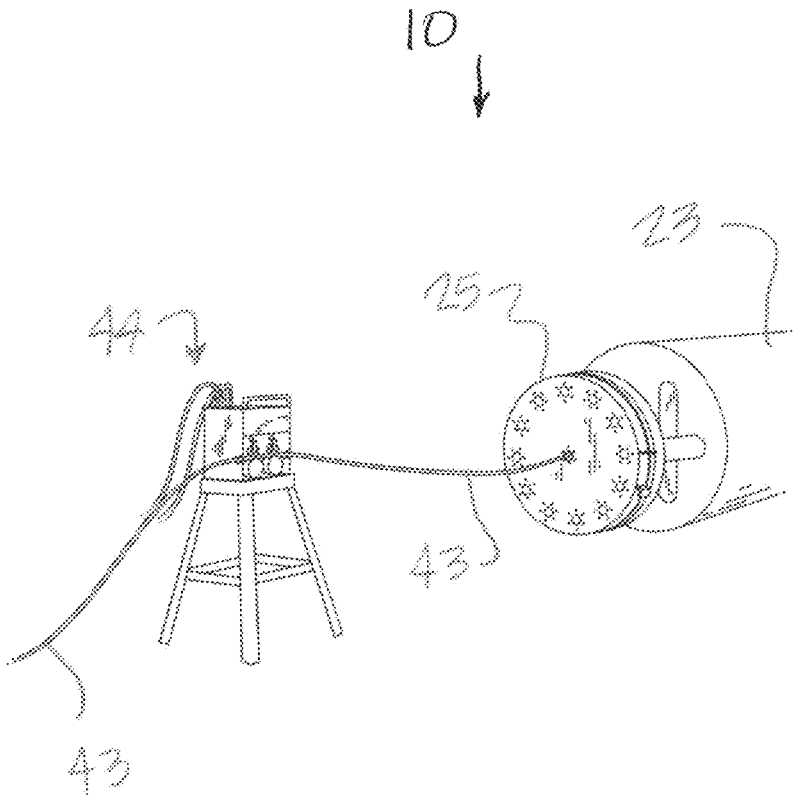
FIG. 13 is a perspective view of a preferred embodiment of the apparatus of the present invention and showing the method of the present invention.
Figure 14:
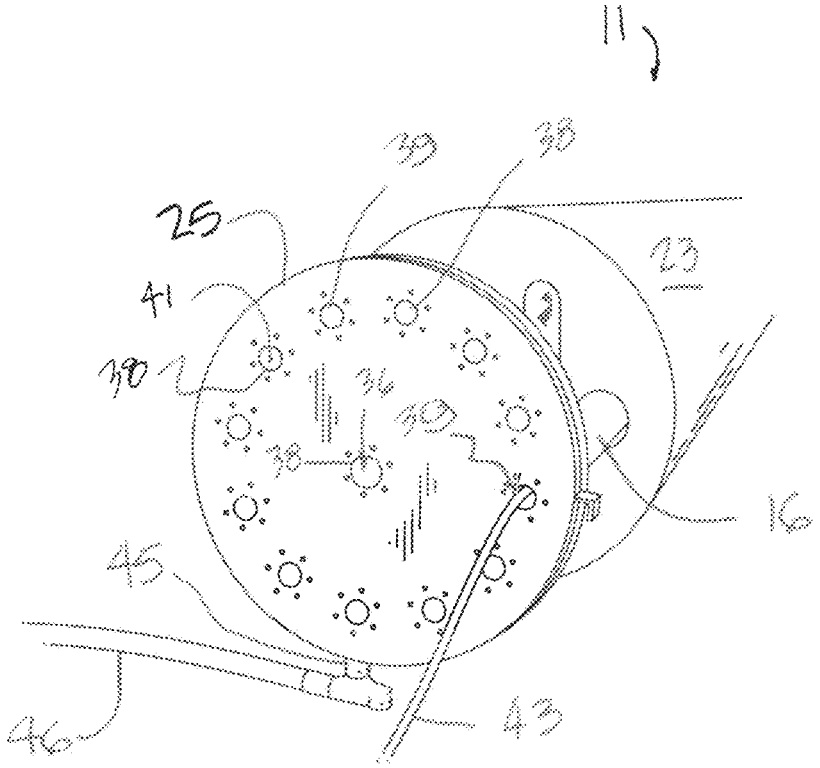
FIG. 14 is a perspective view of a preferred embodiment of the apparatus of the present invention and showing the method of the present invention.

FIGS. 1-15 show a preferred embodiment of the apparatus of the present invention designated generally by the numeral 10 in FIG. 13. Riser cleaning apparatus 10 is used to clean a riser assembly such as the riser assembly 11 (FIGS. 1, 2) or the riser assembly 11A (FIG. 3) shown in the drawings. Such a riser assembly 11 or 11A has a first end portion 12 and second end portion 13. Either or both of the end portions 12, 13 of the riser assembly 11, 11A can be provided with an annular flange 14. The riser assembly 11 or 11A typically includes a larger diameter pipe or tubular member 15 surrounded by multiple smaller diameter pipes or tubular members 16.

The larger diameter pipe 15 has a pipe bore 17 of larger diameter. The smaller diameter pipes 16 each have a pipe bore 18 of smaller diameter. Flange 19 is preferably an annular flange that can be a part of a riser assembly 11 or 11A. In the flange 19, there are openings 20 that do not align with a particular smaller diameter pipe 16. During cleaning of such a flange 19, plugs 21 or 22 are used to block the openings 20 so that fluid is not leaked through the openings 20. The riser assembly 11 or 11A can include an insulation layer 23 or protective covering or coating 23 (e.g., see FIG. 13).

Figure 7:
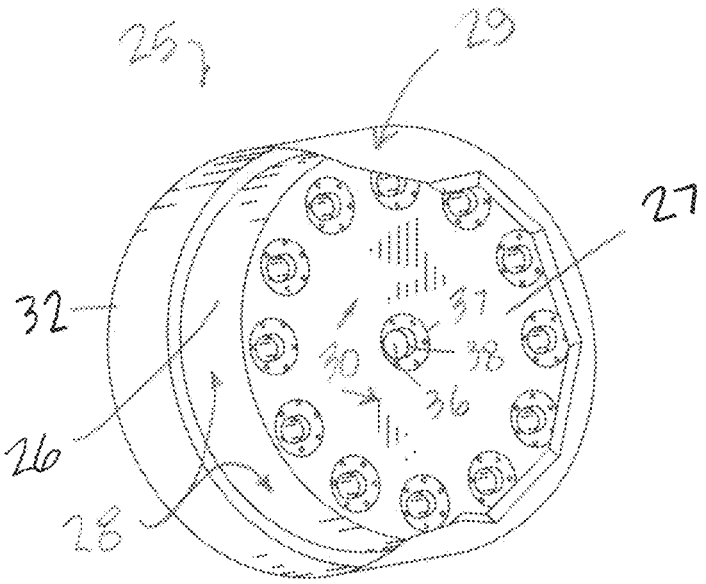
FIG. 7 is a partial perspective view of a preferred embodiment of the apparatus of the present invention showing the shroud.
Figure 8:
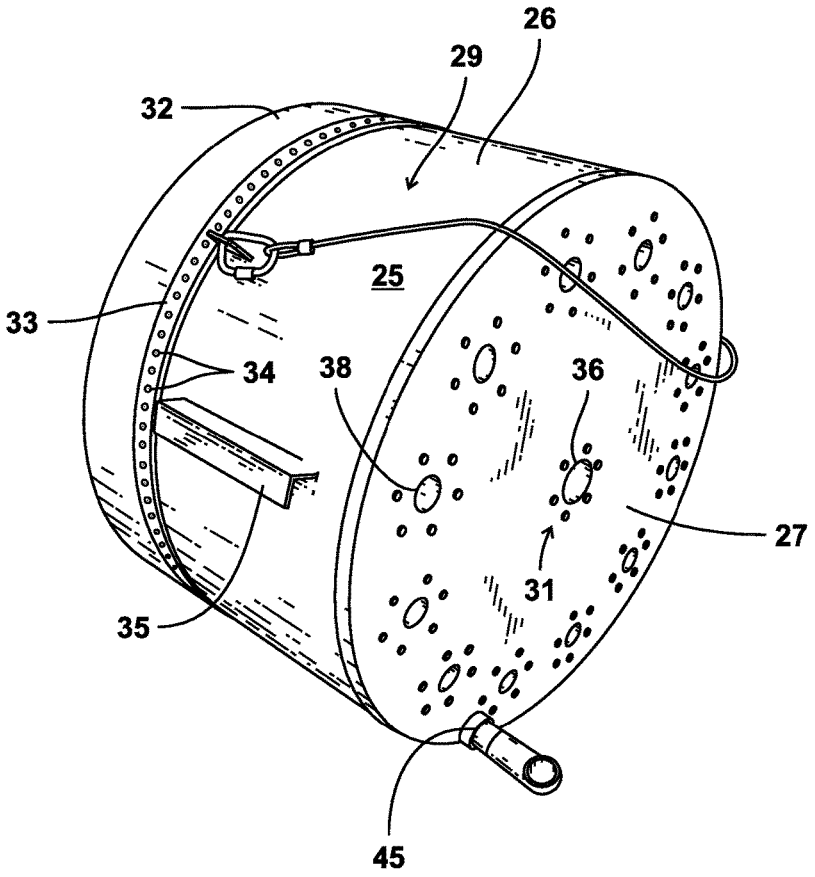
FIG. 8 is a partial perspective view of a preferred embodiment of the apparatus of the present invention showing the shroud.
Figure 9:
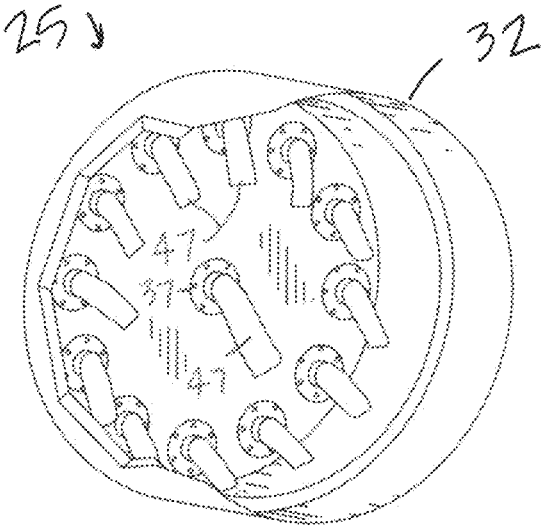
FIG. 9 is a partial perspective view of a preferred embodiment of the apparatus of the present invention showing the shroud.

The apparatus 10 of the present invention and the method of the present invention preferably employ one or more caps, fittings or shrouds 25 as seen in FIGS. 7-9. These caps, fittings or shrouds 25 can be placed on one end portion 12 of the riser assembly 11 or on both end portions 12, 13 of the riser assembly 11.

Each cap, fitting or shroud 25 preferably includes a cylindrical section 26, a circular wall 27, and a concave portion or cavity 24. Wall 27 can be welded to cylindrical section 26. The cylindrical section 26 has an inner surface 28 and an outer surface 29. The circular wall has an inner surface 30 and an outer surface 31.

Figure 10:
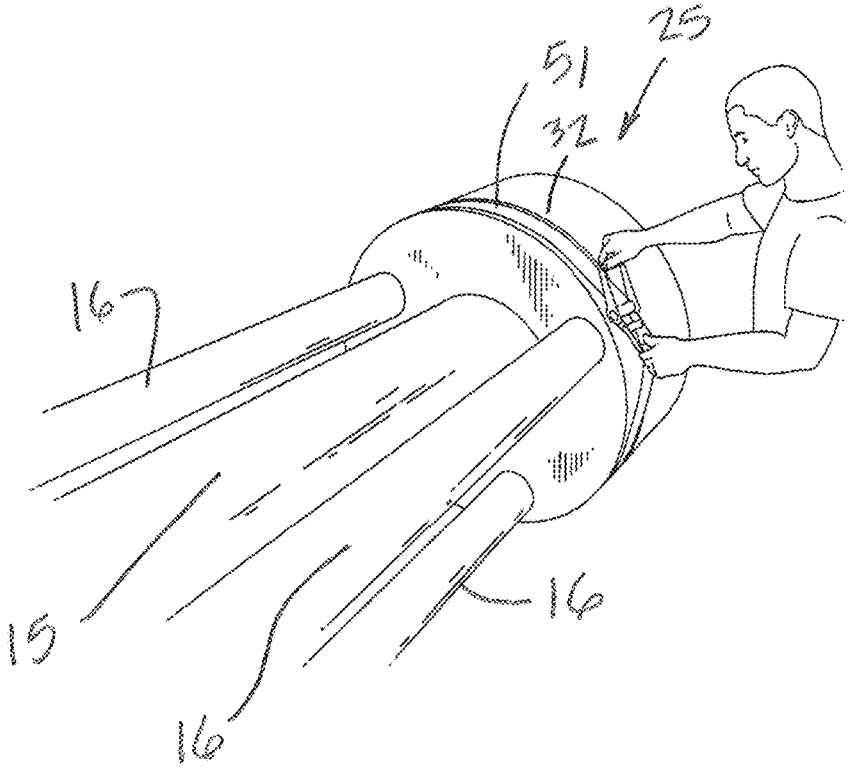
FIG. 10 is a perspective view showing attachment of the shroud to the riser pipe.
Figure 11:
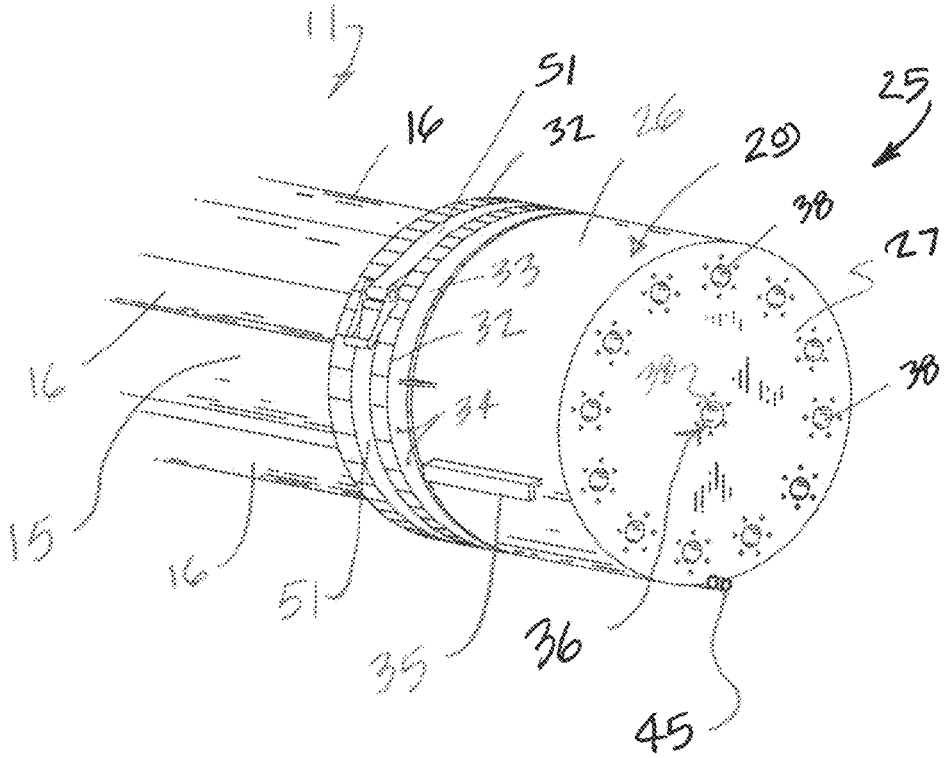
FIG. 11 is a perspective view showing attachment of the shroud to the riser pipe.
Figure 12:
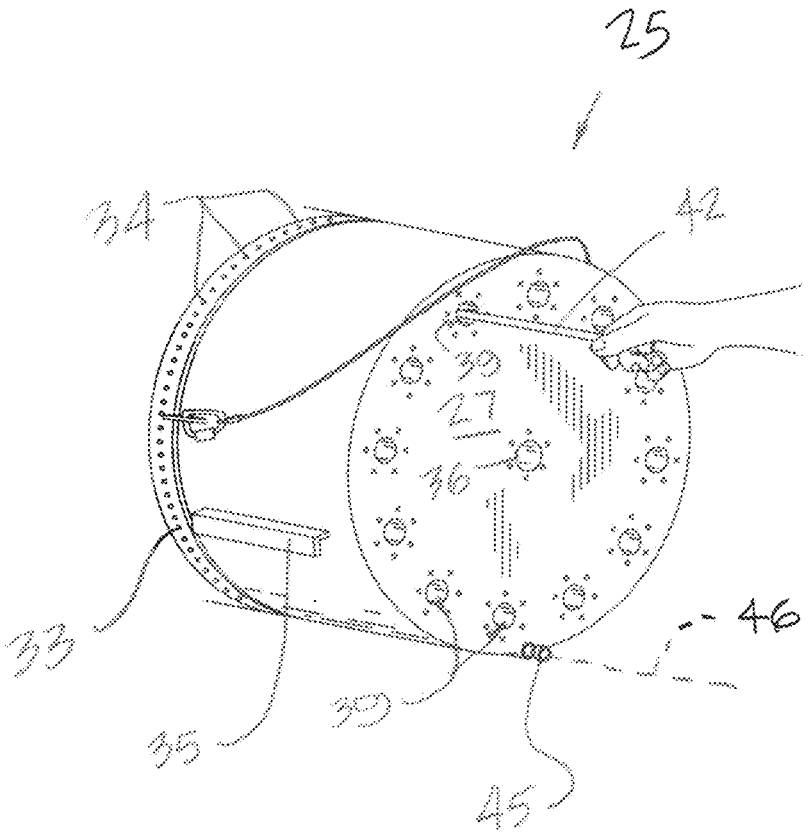
FIG. 12 is a perspective view showing attachment of the shroud to the riser pipe.

A gasket or seal 32 can be attached to cylindrical section 26. The gasket or seal 32 can be attached to the cylindrical section 26 using band 33 and fasteners such as rivets 34. Straps 51 can be used to hold each cap, fitting or shroud 25 to a selected end portion 12, 13 of a riser assembly 11 or 11A. In FIG. 10, workers can be seen securing a cap or fitting 25 to a flange 14 wherein the gasket 32 contacts the outer periphery of the flange 14. One or more handles 35 can be attached (for example, welded) to cylindrical section 26 of cap or shroud 25. The shroud 25 is thus attached to flange 14 of riser 11 in a sealing fashion so that cleaning fluid does not escape around flange 14.

The circular wall 27 is preferably provided with a plurality of openings. These openings include central opening 36 and a plurality of peripheral openings 39. Each opening 36, 39 can be fitted with a flange 37 and a seal 38 (e.g., a rubber seal, polymeric seal, sheet of rubber). In one embodiment, the flange 37 is preferably bolted to the circular wall 27 with fasteners, thus sandwiching the seal 38 or rubber sheet in between the flange 37 and the circular wall 27.

Each peripheral opening 39 is preferably fitted with a flange 40 and can include a seal 38 or rubber sheet. Central opening 36 enables entry of a cleaning tool through the seal or rubber sheet 38 and into a selected pipe 15 or 16 to be cleaned.

A hose 43 supplies pressurized fluid to jetting tool 42. Each seal or rubber sheet 38 or rubber sheet can have a small opening at 41 which allows insertion of the jetting tool 42 and its pressurized hose 43 from the outer surface 31 of circular wall 27 to the inner surface 30 of circular wall 27, thus gaining access to the bore 17 or 18 of a selected larger diameter pipe 15 or smaller diameter pipe 16 to be cleaned.

A hose feed device 44 can be used to feed hose 43 into the selected bore 17 or 18 during cleaning, thus advancing the cleaning tool into and along a selected bore 17 or 18 until all of it is cleaned (i.e., inside surface of pipe 15 or 16). Such a hose feed device 44 is commercially available (e.g., Stone Age Autobox Model ABX-500).

Each cap or shroud 25 has an outlet fitting 45 to which is attached a suction line 46. The suction line 46 would be coupled to a pump or like device that pulls the suction on the outlet fitting 45 and thus the interior of the riser assembly 11 or 11A. In one embodiment, caps or fittings or shrouds 25 are placed at both ends of the riser assembly 11 or 11A, each of the caps or shrouds 25 having an outlet fitting 45 and a suction line 46. In this fashion, the suction lines 46 and their pumps assist in holding the caps or shrouds 25 to the riser assembly 11 or 11A by subjecting the entire interior of the riser assembly 11 or 11A to a vacuum. Hoses 47 can be attached to each flange 37, 40 (see FIG. 9). Such hoses 47 can be ell shaped and flexible. Hoses 47 discourage leakage of cleaning fluid from cap or fitting 25.

Figure 15:
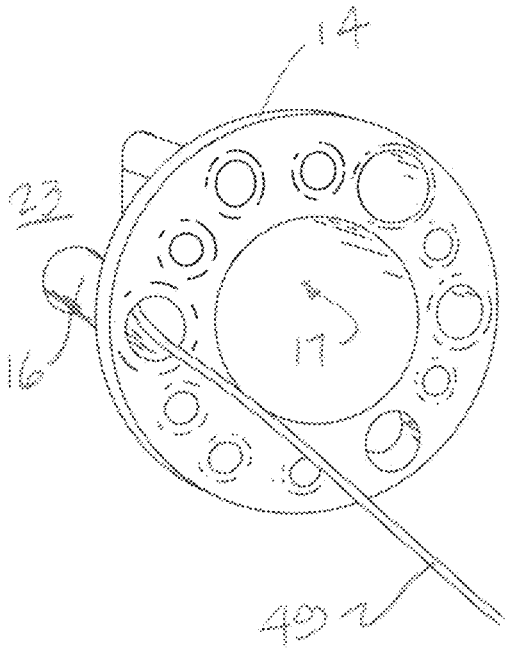
FIG. 15 is a perspective view of a preferred embodiment of the apparatus of the present invention and showing the method of the present invention.
Figure 16:
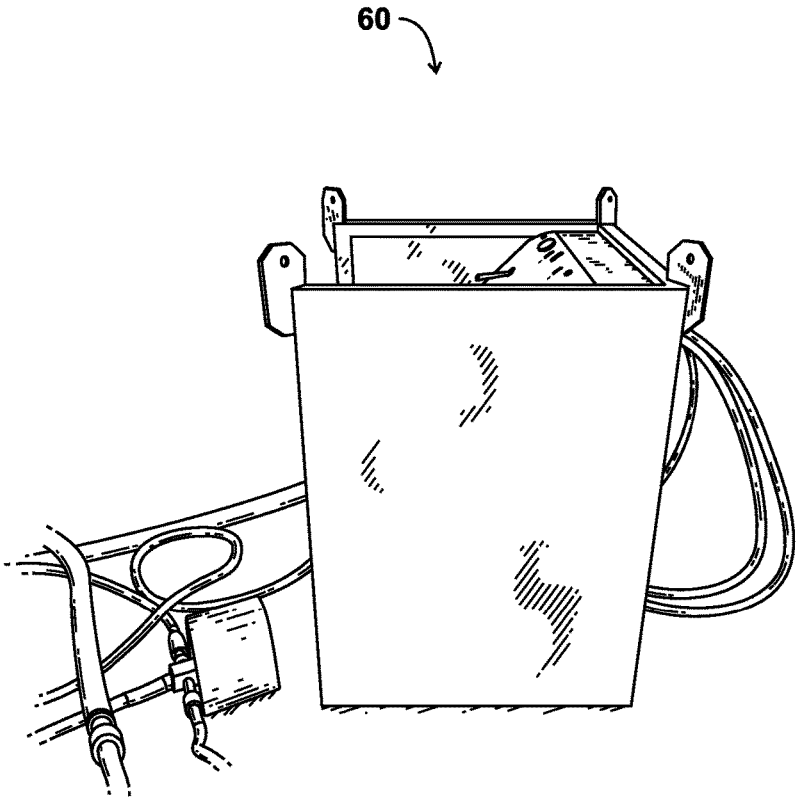
FIG. 16 is a perspective view of the control panel of a preferred embodiment of the apparatus of the present invention and showing the method of the present invention.
Figure 17:
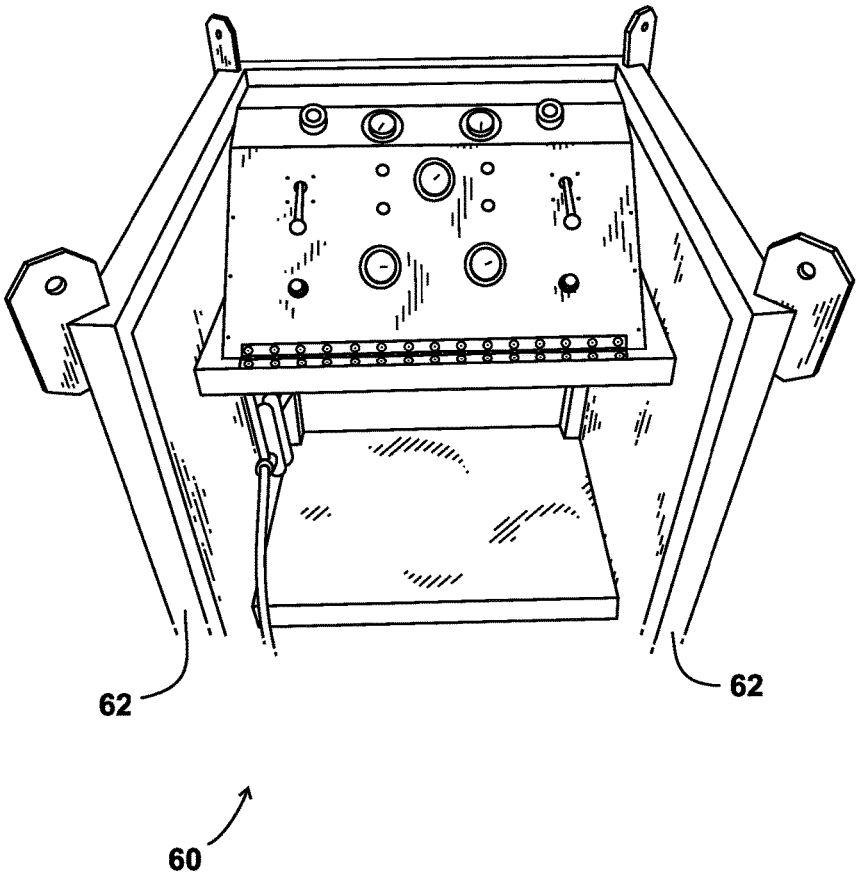
FIG. 17 is a perspective view of the control panel of a preferred embodiment of the apparatus of the present invention and showing the method of the present invention.
Figure 18:
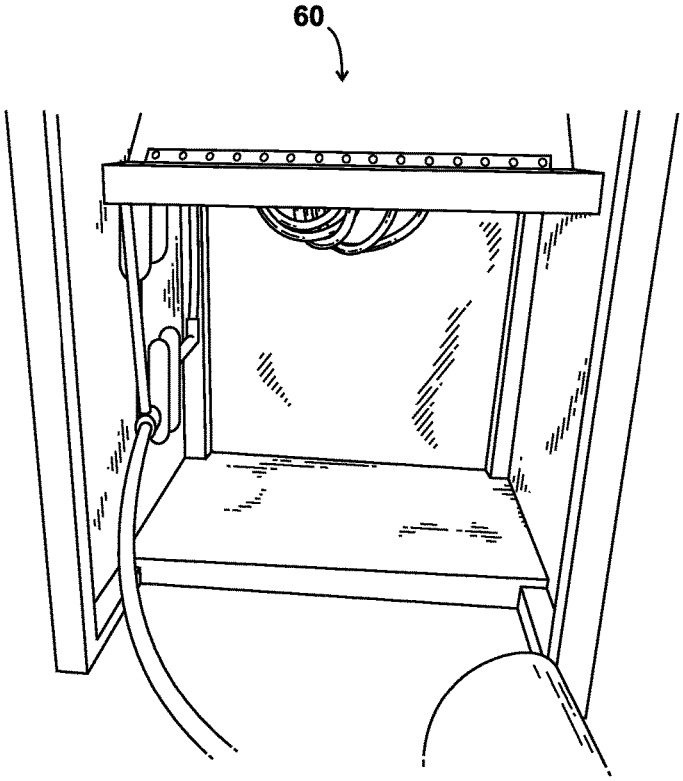
FIG. 18 is a perspective view of the control panel of a preferred embodiment of the apparatus of the present invention and showing the method of the present invention.
Figure 19:
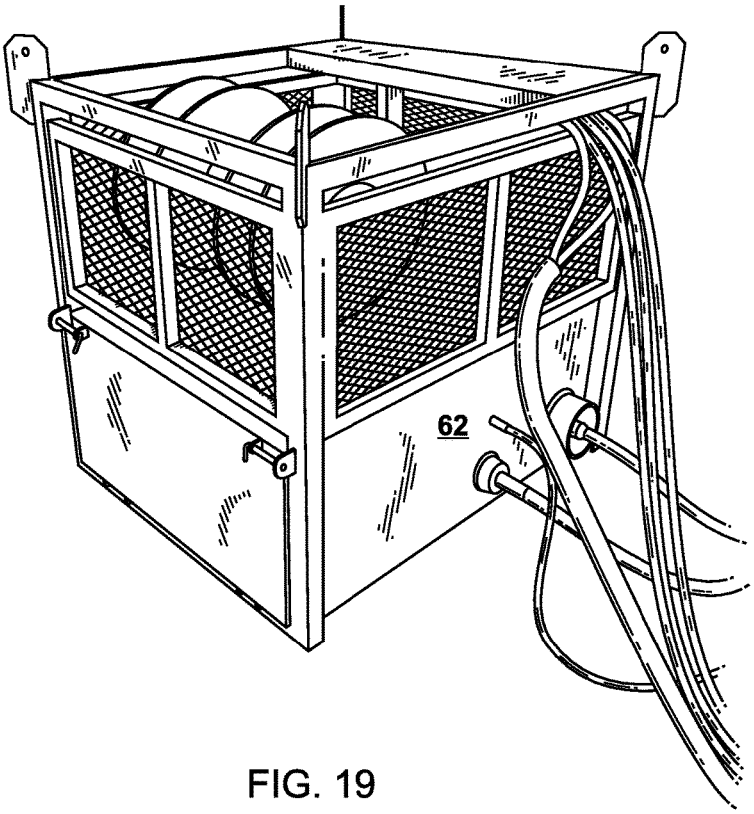
FIG. 19 is a perspective view of the spool basket of a preferred embodiment of the apparatus of the present invention and showing the method of the present invention.
Figure 20:
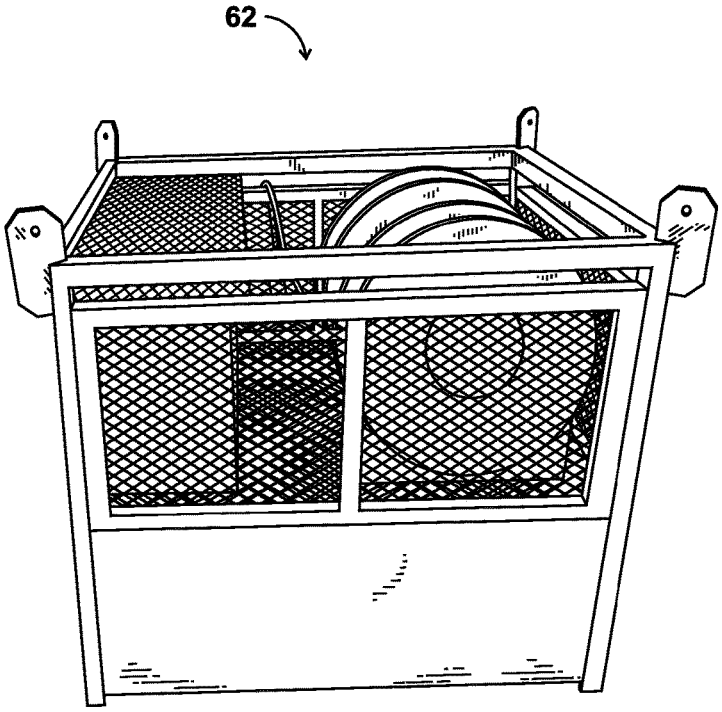
FIG. 20 is a perspective view of the spool basket of a preferred embodiment of the apparatus of the present invention and showing the method of the present invention; and, FIG. 21 is a perspective view of the spool basket and control panel of a preferred embodiment of the apparatus of the present invention and showing the method of the present invention.
Figure 21:
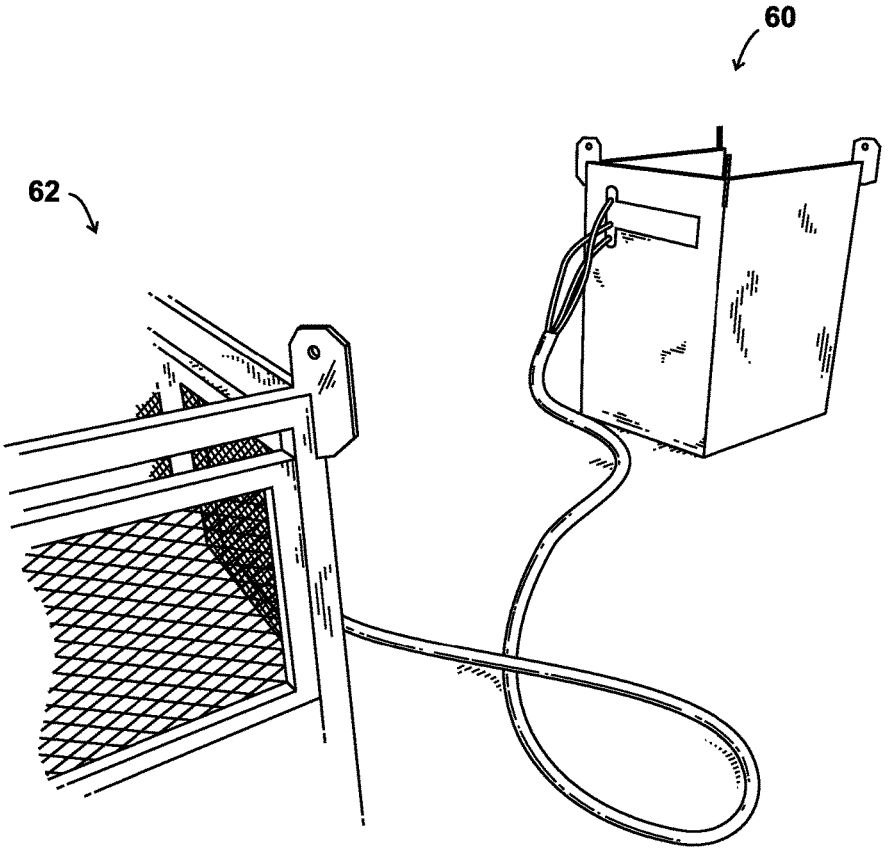

Once cleaning is finished, a camera or like device can be used for inspecting the bores 17 or 18. A camera line 49 can be provided as well as a camera feed device 50 for inserting the camera into a selected bore 17 or 18, as shown in FIG. 15.

FIGS. 16-21 show an alternate apparatus for enabling the cleaning operation to work faster. A preferred embodiment of FIGS. 1-15 shows the cleaning of risers by sending a high-pressure cleaning tool down only one of the pipe bores 17, 18 of the pipes 15, 16 of the riser, by way of a pneumatic feeder 44. Another preferred method addresses the demand that the cleaning occur in a faster total time. To accomplish a faster cleaning time, another preferred embodiment of the present invention includes cleaning preferably all of the bores 17, 18 of a riser 11, 11A simultaneously. The largest bore 17 will preferably be cleaned by sending a high-pressure cleaning tool 42, by way of a pneumatic feeder 44 on one end. The smaller bores 18 can be cleaned in the same aforementioned fashion on the opposite end of the riser 11 or 11A all at once.

To accomplish this, multiple tools 42 are used to control the feeding of the high-pressure water hoses 43, the cleaning tools 42 attached to each of them.

In FIGS. 16-18 and 21 is shown a pneumatic control panel 60 that controls, pneumatically, multiple high-pressure water hose feeders 44, (such as Autobox brand) feeders 44 manufactured by Stone Age Tools—http://www.stoneagetools.com/. The controller or control panel 60 shown is controlling two feeders 44.

In FIGS. 1-7 and 19-21 is a rack 62, with pad-eyes for industrial transportation, that can be used to hold the feeders 44 and a spool of high-pressure water hose.

These two tools were invented for the purpose of controlling multiple high-pressure water cleaning tools, simultaneously with minimal man-power and minimal human exposure to moving parts.

On a typical job there might be two of tool 60 and two of tool 62, with tool 62 at each end of a riser 11 or 11A. The two of tool 60 can be side by side or remote from one another. Typically there will be a separate human operator for each tool 60, though if they are side by side one human operator can operate both.

The following is a list of parts and materials suitable for use in the present invention:

PARTS LIST

| PART NUMBER | DESCRIPTION |
|---|---|
| 10 | riser cleaning apparatus |
| 11 | riser assembly |
| 11A | riser assembly |
| 12 | first end portion |
| 13 | second end portion |
| 14 | annular flange |
| 15 | larger diameter pipe |
| 16 | smaller diameter pipe |
| 17 | pipe bore (larger diameter) |
| 18 | pipe bore (smaller diameter) |
| 19 | flange |
| 20 | opening |
| 21 | plug |
| 22 | plug |
| 23 | insulation/protective covering |
| 24 | concave portion/cavity |
| 25 | cap/shroud/fitting |
| 26 | cylindrical section |
| 27 | circular wall |
| 28 | inner surface |
| 29 | outer surface |
| 30 | inner surface |
| 31 | outer surface |
| 32 | gasket/seal |
| 33 | band |
| 34 | fastener/rivet |
| 35 | handle |
| 36 | central opening |
| 37 | flange |
| 38 | seal |
| 39 | peripheral opening |
| 40 | flange |
| 41 | opening |
| 42 | jetting tool |
| 43 | hose |
| 44 | hose feed device |
| 45 | outlet fitting |
| 46 | suction line |
| 47 | hose |
| 49 | camera line |
| 50 | camera feed device |
| 51 | strap |
| 60 | pneumatic control panel |
| 62 | rack |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An oil and gas well riser cleaning apparatus for cleaning a riser having a central larger diameter tubular member having a larger flow bore and a plurality of smaller diameter tubular members connected to the central larger diameter tubular member, each smaller diameter tubular member having a smaller flow bore, comprising:

a) a fitting that is attachable to a first end portion of the oil and gas well riser section, the fitting covering said first end and the ends of the smaller diameter tubular members;

b) wherein the fitting has multiple openings including one or more centrally located openings and a plurality of circumferentially spaced apart outer openings that are spaced radially away from each of the one or more centrally located openings, said fitting having a fluid drain;

c) a first cleaning tool that is insertable through the centrally located opening and into the larger diameter tubular member larger bore, wherein said first cleaning tool provides fluid for cleaning the inside surface of the larger diameter tubular member;

d) a second cleaning tool that is insertable through one of the outer openings and into one of the smaller diameter tubular members smaller bore, wherein said second cleaning tool provides fluid for cleaning the inside surface of the smaller diameter tubular member;

e) wherein the outer openings are positioned along a curved line that is radially spaced outwardly of the centrally located opening or openings, said curved line traversing each of said smaller diameter tubular members;

f) wherein said fitting includes a peripheral portion; and g) the peripheral portion configured to attach to the oil and gas well riser.

2. The apparatus of claim 1, wherein each said one or more centrally located openings is generally aligned with the larger flow bore of the larger diameter tubular member, and each said outer opening is generally aligned with the bore of a said smaller diameter tubular member.

3. The apparatus of claim 1, wherein the oil and gas well riser section has one end portion with an annular flange, each tubular member connected to said annular flange, and in step "a" the fitting attaches to said annular flange.

4. The apparatus of claim 3, wherein the annular flange has an outer diameter and the fitting has a peripheral skirt having a diameter that is about equal to the flange outer diameter.

5. The apparatus of claim 1, wherein the oil and gas well riser section has two end portions, one at each end of the oil and gas well riser section, and wherein there are a pair of said fittings, wherein one of the fittings is attachable to one end portion of the oil and gas well riser section, and the other of the fittings is attachable to the other end portion of the oil and gas well riser section.

6. The apparatus of claim 5, further comprising a vacuum source that at least in part holds the fittings to the oil and gas well riser section.

7. The apparatus of claim 1, wherein some of the outer openings are aligned with a smaller diameter tubular member bore and some of the outer openings are not aligned with a smaller diameter tubular member bore.

8. The apparatus of claim 1, wherein said first cleaning tool is configured to clean the inside surface of the larger diameter tubular member while simultaneously or substantially simultaneously said second cleaning tool is configured to clean the inside surface of the smaller diameter tubular member.

9. The apparatus of claim 1, wherein said cleaning tool provides fluid for cleaning the inside surface of the one or more of smaller diameter tubular members, and wherein said first cleaning tool is configured to clean the inside surface of the larger diameter tubular member while simultaneously or substantially simultaneously second, third, and fourth cleaning tools are configured to clean the inside surfaces of the smaller diameter tubular members.

10. The apparatus of claim 1, further comprising multiple separate cleaning tools, one for each of said tubular members, and wherein all cleaning tools are configured to simultaneously or substantially simultaneously clean the inside surfaces of the tubular members.

11. The apparatus of claim 1 wherein there are multiple said fittings placed at both oil and gas well riser section end portions.

12. The apparatus of claim 1 wherein the first cleaning tool is insertable into a first end of the oil and gas well riser section and the second cleaning tool is insertable into a second end portion of the oil and gas well riser section.

13. An oil and gas well riser section cleaning apparatus, said riser section having a first end portion and a second end portion, said oil and gas well riser section having a central larger diameter tubular member having a flow bore and a plurality of smaller diameter tubular members connected to the central larger diameter tubular member, each smaller diameter tubular member having a flow bore, comprising:

a) first and second fittings attachable on the first and second end portions of the oil and gas well oil and gas well riser section;

b) each fitting covering an end of the larger diameter tubular member and the ends of the smaller diameter tubular members;

c) wherein one said fitting has multiple openings including one or more centrally located openings and a plurality of circumferentially spaced apart outer openings that are spaced radially away from each of the one or more centrally located openings, one or both of said fittings having a drain opening;

d) a first cleaning tool that is insertable through the centrally located opening and into the larger diameter tubular member, wherein the cleaning tool is configured to clean the inside surface of the larger diameter tubular member with a pressurized cleaning fluid;

e) the cleaning tool insertable through one of the outer openings and into one of the smaller diameter tubular members, wherein said first cleaning tool cleans the inside surface of the smaller diameter tubular member with a pressurized cleaning fluid;

f) said drain opening positioned to collect cleaning fluid from said cleaning tool; and g) wherein the outer openings are positioned along a curved line that is radially spaced outwardly of the one or more centrally located openings, said curved line traversing each of said smaller diameter tubular members.

14. The apparatus of claim 13, wherein when a said fitting is connected to said riser section, each said one or more centrally located openings is generally aligned with the bore of the larger diameter tubular member and each said outer opening is generally aligned with the bore of a said smaller diameter tubular member.

15. The apparatus of claim 13, wherein the oil and gas well riser section has one end portion with an annular flange, each tubular member connected to said flange, and the fitting is configured to attach to said annular flange.

16. The apparatus of claim 15, wherein the annular flange has an outer diameter and the fitting has a peripheral skirt having a diameter that is about equal to the flange outer diameter and the fitting attaches to at the peripheral skirt to the annular flange.

17. The apparatus of claim 15, wherein there are a pair of said fittings and a said fitting is attached to each end portion of the oil and gas well riser section and further comprising a suction is applied to each of the fittings to subject all said flow bores of the oil and gas well riser section to a vacuum.

18. The apparatus of claim 13, wherein some of the outer openings are aligned with a smaller diameter tubular member bore and some of the outer openings are not aligned with a smaller diameter tubular member bore.

19. The apparatus of claim 13, further comprising a second cleaning tool and wherein said first cleaning tool cleans the inside surface of the larger diameter tubular member while simultaneously or substantially simultaneously said second cleaning tool cleans the inside surface of the smaller diameter tubular member.

20. The apparatus of claim 13, further comprising multiple cleaning tools for cleaning said outer smaller diameter tubular members, and wherein a first cleaning tool cleans the inside surface of the larger diameter tubular member while simultaneously or substantially simultaneously said one or more of multiple cleaning tools clean the inside surfaces of the smaller diameter tubular members.

21. The apparatus of claim 13, further comprising multiple separate cleaning tools as there are tubular members, and wherein all cleaning tools simultaneously or substantially simultaneously clean the inside surfaces of the tubular members.

22. An oil and gas well riser section cleaning apparatus for cleaning a riser section having a first end portion and a second end portion, the riser section having a central larger diameter tubular member having a flow bore and a plurality of smaller diameter tubular members connected to the central larger diameter tubular member, each smaller diameter tubular member having a flow bore, comprising:

a) first and second fittings attachable to the first and second end portions respectively of the riser section, each fitting covering an end of the larger diameter tubular member and the ends of the smaller diameter tubular members;

b) wherein one said fitting has multiple openings including one or more centrally located openings and a plurality of circumferentially spaced apart outer openings that are spaced radially away from each of the one or more centrally located openings;

c) a cleaning tool insertable through the centrally located opening and into the larger diameter tubular member;

d) wherein the cleaning tool is configured to clean the inside surface of the larger diameter tubular member with a pressurized cleaning fluid;

e) the cleaning tool being insertable through one of the outer openings and into one of the smaller diameter tubular members;

f) wherein said cleaning tool cleans the inside surface of the smaller diameter tubular member with a pressurized cleaning fluid;

g) a drain on one or both said fittings that collects cleaning fluid from cleaning tools; and h) wherein the outer openings are positioned along a curved line that is radially spaced outwardly of the one or more centrally located openings, said curved line traversing each of said smaller diameter tubular members.

* * * * *